US005384559A

United States Patent [19]

Shamir

[11] Patent Number: 5,384,559

[45] Date of Patent: Jan. 24, 1995

[54] FUSE PLUG WITH REPLACEMENT FUSE STORAGE

[75] Inventor: Amos Shamir, Riverdale, N.Y.

[73] Assignee: Paramount Die & Machine Products, Inc., Brooklyn, N.Y.

[21] Appl. No.: 183,832

[22] Filed: Jan. 21, 1994

[51] Int. Cl.[6] ..... H01H 85/02

[52] U.S. Cl. ..... 337/197; 337/208

[58] Field of Search ..... 337/197, 198, 208, 209, 337/210; 439/622

[56] References Cited

U.S. PATENT DOCUMENTS

| | | | |
|---|---|---|---|
| 2,742,545 | 4/1956 | Sundt | 337/198 |
| 4,575,704 | 3/1986 | Pezold | 337/197 |
| 4,768,979 | 9/1988 | Wu | 337/197 |
| 5,176,539 | 1/1993 | Liu | 439/622 |
| 5,281,943 | 1/1994 | Liao | 337/198 |

FOREIGN PATENT DOCUMENTS 624160 12/1935 Germany .

*Primary Examiner*—Lincoln Donovan
*Attorney, Agent, or Firm*—Sherman and Shalloway

[57] ABSTRACT

A combination plug and fuse holder with replacement fuse storage provides fuse protection. In addition, it provides a means whereby a replacement fuse of the same size and type may be conveniently stored within the plug, yet out of electrical contact, and is readily available when it becomes necessary to replace a blown fuse within the plug. The fuse plug is of molded fire-retardant plastic having three separate members that are hinged together to form an integral unit. The housing members include a base member, an overlying body member hinged to the base member, together forming a fuse-accommodating pocket, and an end member hinged to the base member and carrying one of the electrical prongs. The other electrical prong extends from the body member and the electrical cord is adapted to fit between the base and the body members. A cavity is provided within the base member parallel to the fuse-accommodating pocket in which the replacement fuse is housed. Removal of a blown fuse from the pocket and the replacement fuse from the cavity followed by placement of the replacement fuse in the pocket and a further replacement fuse in the cavity is accomplished simply by unlocking the end member and pivoting it from the base member thus exposing the ends of the fuses which extend from the end of the base member. In addition, the design of a passage in which the cord fits contributes to electrical safety of the plug by maintaining the cut ends of the cord in such a manner that they cannot come into contact with each other to produce an electrical short circuit.

14 Claims, 2 Drawing Sheets

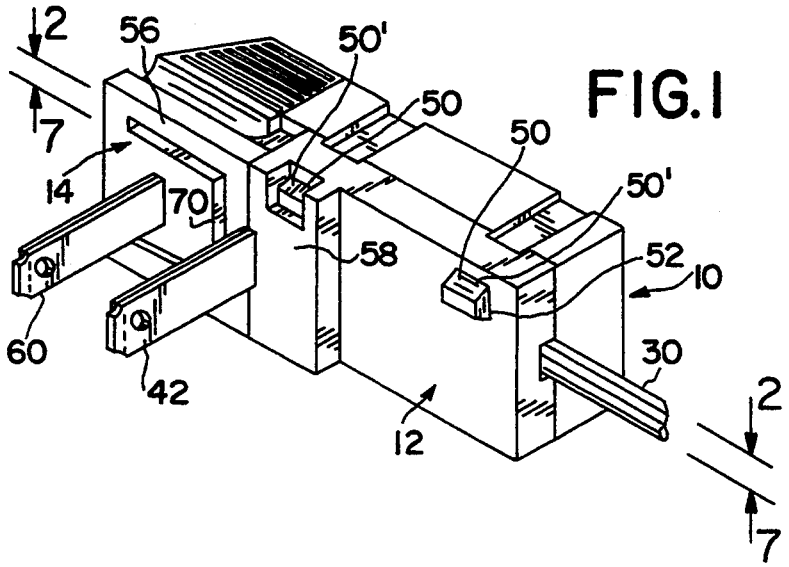
FIG.1
FIG.2
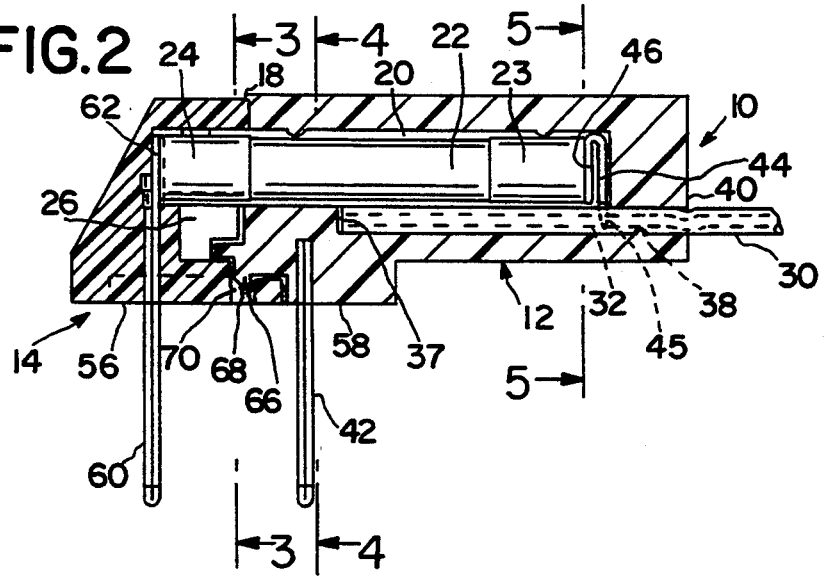
FIG.3
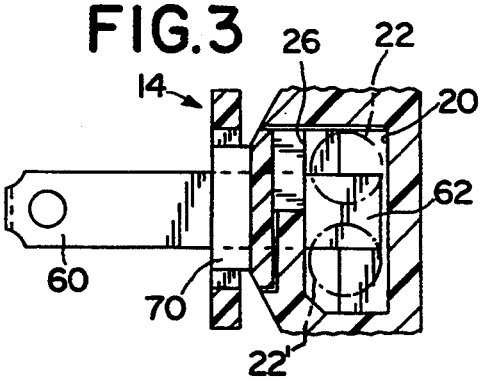
FIG.4
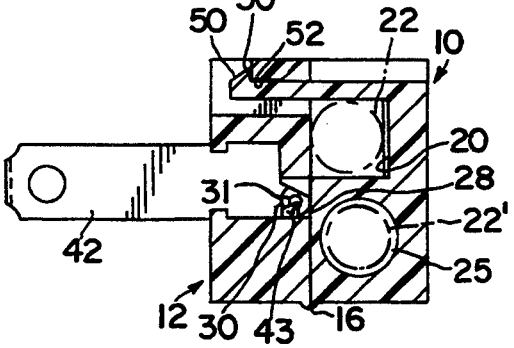

FUSE PLUG WITH REPLACEMENT FUSE STORAGE

BACKGROUND OF THE INVENTION

The present invention is an improvement over the present inventor's prior use plug as represented by U.S. Pat. No. 4,418,978 which is incorporated herein by reference thereto. The present invention relates in general to fusing in connection with electrical devices, and pertains, more particularly to a combination plug and fuse holder whereby a fuse connection is provided between one of the prongs of the plug and one conductor of an electrical cord. Preferably, the present invention is embodied in a single integral unit preferably constructed of a fire retardant plastic and having a means whereby a spare fuse may be stored within the plug out of electrical contact with the electrical cord.

There have been recent requirements for the use of a fuse directly in connection with certain electrical appliances such as the requirement for fusing a Christmas light string. The usual technique for incorporating the fuse is to provide a separate fuse and associated holder connected into the electrical cord at some position along its length. However, this arrangement usually makes it relatively difficult to provide for replacement of the fuse in an easy manner. In addition, it fails to provide any means for retaining a replacement fuse in close proximity to the fuse holder so that the replacement fuse is at hand when it is needed.

Accordingly, one object of the present invention is to provide a combination fuse holder and plug preferably provided in an integral unit and wherein the fuse is very simple to replace without requiring the disconnection of any parts.

Among other objects of the present invention is the object of providing a fuse plug in which the assembly of the fuse on the cord is facilitated at a low cost without requiring wire stripping or notching and wherein the possibility of live ends of the cord touching is prevented. In accordance with this invention the electrical cord is cut with one conductor longer than the other and is placed into the housing in a channel designed to accommodate a cord so cut but without requiring any stripping or notching to expose the wire therein.

Another object of the present invention is to provide a combination plug and fuse holder which enables the ready addition of fuse protection to existing equipment or appliances virtually without the use of any tools. If an appliance or equipment is only provided with the usual plug and it is desired to provide fuse protection, then the combination plug and fuse holder of this invention may readily be substituted in place for the conventional plug. This provides the dual operation of a plug and a fuse with the incorporation of a single unit to the electrical cord.

A further object of the present invention is to provide a fusing arrangement for an electrical cord in which fuse replacement is permitted only when the unit is unplugged from an electrical outlet and in which provision is made for storing a replacement fuse in a manner which is convenient and readily available. Furthermore, in accordance with this invention, the fuse can be replaced without disturbing any electrical contact points to the wire.

Still another object of the present invention is to provide a combination fuse holder and plug as an integral unit in which the electrical cord is not easily disengagable with the housing and wherein the housing includes a provision for storage of a replacement fuse out of electrical contact with the cord.

Another object of the present invention is to provide a combination fuse holder and plug that is preferably in a single unit thus eliminating any separate two-piece unit. This is accomplished by making the end connector or plug embodied in a housing that also forms a fuse holder.

SUMMARY OF THE INVENTION

To accomplish the foregoing and other objects of this invention there is provided a combination fuse holder and plug preferably formed in an integral unit and preferably of a fire retardant plastic material. This housing is preferably formed in three separate members including a base member, an overlying body member and an end member. The body member is hinged along an edge from the base member and the end member is similarly hinged from an end edge of the base member. The base and body members together define a channel for accommodating the electrical cord. The channel has a configuration whereby one conductor of the electrical cord is cut shorter than the other to fit therein thereby ensuring that the bare ends of the conductors do not inadvertently meet. Also, the base member has an elongated pocket for accommodating the majority of a first fuse which is in electrical contact with one conductor of the cord. Within the base member is a second cavity which extends into the base member from the end face of the base member adjacent to the end member and which is parallel parallel to and horizontally spaced from the pocket. This second cavity has dimensions to substantially accommodate the majority of a second fuse thereby providing a storage means for a second fuse which may be used as a replacement for the fuse in the pocket. The second cavity is separated from the slot and from the electrical cord and connections therewith by the material of the housing.

The fuse plug normally accommodates elongated cylindrical buss fuses. One end of the first fuse extends from the pocket into an accommodating opening in the end member for contact by one of the prongs. The other prong is supported from the body member and has an inner end which directly contacts one of the conductors of the electrical cord. The other conductor of the electrical cord contacts a further contact member that is engaged with the other end of the first fuse within the pocket. The electrical circuit is thus formed with the first fuse in series with one of the prongs and one of the conductor leads of the cord. The second fuse is accommodated within the second cavity which is preferably cylindrical and is at least as long as the pocket. When placed therein, the second fuse is substantially completely protected and electrically isolated by the material of the housing.

As previously mentioned, the separate members comprising the apparatus of this invention are hinged relative to each other. In addition, means are provided for enabling the snapping together of these various members for the purpose of providing a unitary fuse holder and plug. The accommodating pocket for the first fuse is dimensioned so that the fuse will slide easily in the pocket but only when the end member is hinged away from the base and body members. Similarly, the dimensions of the second cavity are such that the second fuse is easily slid within the cavity when the end member is hinged away from the base and body members. Thus, for replacement of the fuses within the housing, the end member simply needs to be hinged open to expose the ends of the fuses which can then be easily withdrawn, the first fuse being discarded and the second fuse being placed within the slot. A new fuse can then be placed within the second cavity to be stored until such time as it is needed to replace the fuse within the slot. Following replacement of the fuses, the end member is then hinged from the base member and moved into a locked position to provide a unitary apparatus.

DESCRIPTION OF THE DRAWINGS

FIG. 1 is a perspective view showing the fuse holder and plug in a preferred embodiment in accordance with the present invention.

FIG. 2 is a cross-sectional view taken through the apparatus along line 2—2 of FIG. 1.

FIG. 3 is a transverse cross-sectional view taken through the end member along line 3—3 of FIGS. 2 and 7.

FIG. 4 is a second transverse cross-ssectional view taken along line 4—4 of FIGS. 2 and 7 at one end of the base and body members.

DETAILED DESCRIPTION

Figure 5:
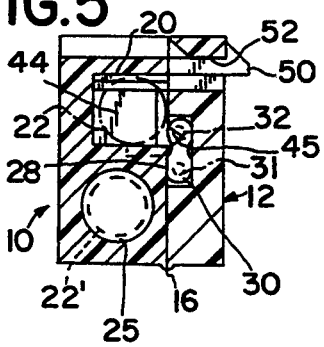
FIG. 5 is a third cross-sectional view taken along line 5—5 of FIGS. 2 and 7.

Referring now to the drawing, there is shown a preferred embodiment for the fuse plug of this invention. This device embodies in a single integral unit both an A/C type plug and a fuse holder and includes a means whereby a second replacement fuse can be stored within the device for ready replacement of a fuse mounted in the fuse holder. The housing comprising the fuse plug is readily separable preferably by hinging to permit easy access to and replacement of a blown fuse. One of the advantages of the construction of this invention is that the fuse can only be replaced when the unit is unplugged. The fuse holder of this invention may be used with any appliance or the like electrical equipment especially those now requiring fuse protection directly in the electrical cord.

The plug-in fuse holder of this invention comprises a housing that is made up of three separate housing sections identified herein as base member 10, overlying body member 12, and end member 14. Each of these members are preferably constructed of the same material such as fire retardant plastic. These housing members interact primarily by means of elongated hinge lines 16 and 18 between different of these members as explained hereinafter. Preferably, the hinge lines are defined by relatively thin plastic bridges between the different members which bridges are of sufficient thickness so as not to break but also sufficiently thin to function as a hinge. Such structures are commonly known as "live" hinges and are molded as an integral part of the structure being hinged. Alternatively, other hinge types, such as the standard pintle hinge, may be used. In the drawing FIG. 6 there is shown a hinge 16 along an elongated edge interconnecting the base member 10 and the overlying body member 12. Similarly, there is provided a hinge 18 at a bottom edge of the base member 10 for hingedly interconnecting the base member 10 and the end member 14.

Figure 7:
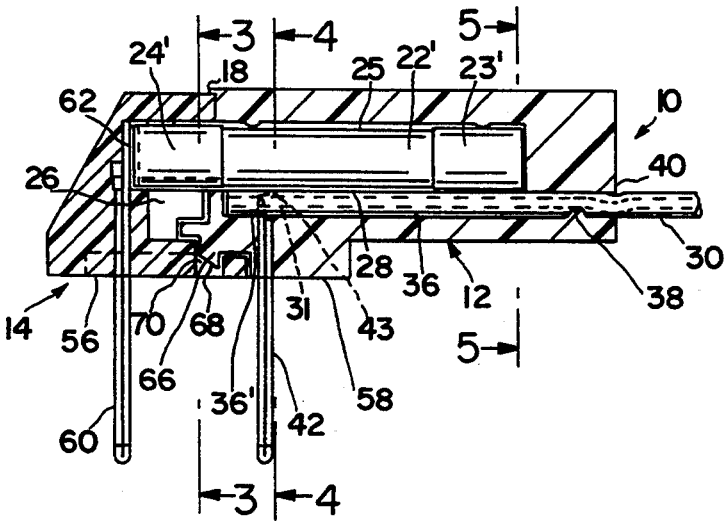
FIG. 7 is a cross sectional view taken through the apparatus along line 7—7 of FIG. 1.

The base member 10 is of generally rectangular shape having an elongated channel or pocket 20 for accommodating the majority of the length of the fuse 22. The fuse may be of many different types and amperage ratings. However, the preferred form and that which is depicted herein is the cylindrical buss type fuse. One fuse that may be employed is a buss AGC 7. As depicted in the drawing FIGS. 2 and 7, the fuse 22 includes metal end caps 23 and 24. The section of the fuse 22 including the end cap 24 it is noted extends outwardly from the pocket 20 in base member 10 into an accommodating slot 26 in the end member 14. Pocket 20 itself is preferably formed as an integral feature along one half of the base member 10 to one side of the longitudinal axis thereof.

The base member 10 also has a surface 28 disposed along the member and substantially defining the other half of the member 10. The top surface 28 also forms a rest surface for one side of the electrical cord 30 as described hereinafter. The electrical cord 30 may be a conventional type of cord having the two conductors 31 and 32 in parallel side-by-side relationship. One of these conductors makes contact with one end of the fuse 22 while the other conductor makes direct contact with one of the plug prongs as described hereinafter.

Within the half of the base member 10 defined by the top surface 28 is formed a cavity 25 extending inward from the end face of base member 10 adjacent to end member 14. Cavity 25 is of a shape and dimension to accommodate a second fuse 22' which is of the same type as fuse 22 held in pocket 20. Accordingly, cavity 25 is preferably cylindrical to accommodate the standard buss type fuses previously described. Preferably cavity 25 has a length which is substantially equal to that of pocket 20 so that one end of second fuse 22' placed therein extends from base member 10 when end member 14 is hinged open. As with first fuse 22, end cap 24' of second fuse 22' fits within slot 26 in end member 14. Also preferably, the diameter of cavity 25 is slightly larger than that of second fuse 22' to permit easy withdrawal of second fuse 22' when needed.

The body member 12 is also of substantially rectangular shape. On its internal surface 27, there is provided an elongated groove 36 that is open to the outside at the end of the body member 12 opposite to end member 14. This groove 36 has a width and a depth that is adapted to readily accommodate a conventional electrical cord 30. As noted in the drawing FIGS. 4, 5 and 7, the cord 30 rests upon the top surface 28 of the base member 10. At the outer end of the groove 36 there is provided a triangular ridge 38 transversely across the groove. Similarly, there is a corresponding ridge 40 which extends outwardly from the end edge of top surface 28 of base member 10. These ridges 38 and 40 are relatively small; however, when the base and body members 10 and 12 are interlocked the tendency is for these ridges to grip the cord 30 and relieve any strain on the contact points with the conductors.

The overlying body member 12 also has a thin passageway for accommodating electrical prong 42. The hole in the body member 12 is arranged so that the prong 42 is tightly fitted in the body member. The prong 42 has a lower pointed end 43 that is adapted to engage the conductor wire 31 when the base and body members are interlocked. Similarly, at the other end of the base member 10, within pocket 20, there is provided a contact piece 44 having a pointed end 45 that is adapted to pierce the other conductor 32 when the base and body members are interlocked. The contact 44 also has a turned end 46 that is adapted to firmly engage with the end piece 23 of the fuse 22. Preferably, turned end 46 is slightly sprung to ensure a positive contact with end piece 23.

Figure 6:
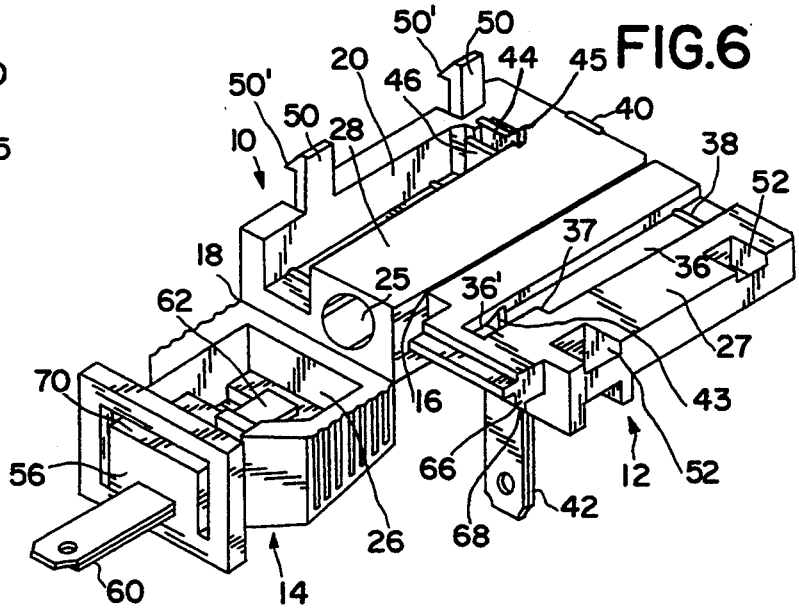
FIG. 6 is a further perspective view showing the fuse holder and plug in its opened position.

Groove 36 is particularly designed to improve electrical safety of the plug device of the present invention by providing a means to prevent contact between the cut ends of the cord 30. Toward this end, the inner end of groove 36 is formed with an extended leg 36' along one side of groove 36 which has a width substantially corresponding to one half of cord 30. Pointed end 43 of prong 42 protrudes into leg 36' to pierce the insulation of cord 30 and thereby provide electrical engagement with the conductor wire 31. As shown in FIG. 6, the other side of groove 36 terminates at an inner end 37 which is rearward of where pointed end 43 of prong 42 protrudes into leg 36'. This configuration necessitates that cord 30 be cut so that conductors 31 and 32 have different lengths and that the ends thereof do not come into contact with each other thereby preventing an electrical short circuit. In addition, by locating pointed end 43 of prong 42 within leg 36', inadvertent contact of both conductors 31 and 32 by pointed end 43 is prevented. Preferably leg 36' of groove 36 is from about ¼" to about ½" long; most preferably, leg 36' is about ¼" long.

The base member 10 is provided with two upright locking posts 50 which are adapted to pass through correspondingly positioned holes 52 in the overlying body member 12. Each of these locking posts 50 has a barbed end 50' so that when the body and base members 10 and 12 are interlocked the barbed ends 50' engage with the top surface of the body member 12 to lock the base and body members 10 and 12 in position. The opposite side of these members is secured by means of the hinge 16.

As previously mentioned, the end cap 24 of the fuse 22 extends into a slot 26 formed on the inside of the end member 14. It is noted that the top wall 56 of the end member is adapted to fit substantially planar with the top wall 58 of the body member 12. This top wall 56 also receives a second prong 60 which is substantially similar to the prong 42 except that this is a longer prong having a base 62 which extends into the slot 26 and which is adapted to electrically interconnect with the flat end of the end cap 24 of the fuse 22. Of course, when the end member is hinged away from the base member 10 then the contact between the fuse 22 and the prong 60 is interrupted.

The end member 14 is hinged along the hinge line 18 from a lower end edge of the base member 10. This hinging preferably occurs by means of a thin plastic bridge, or live hinge, between the different members permitting the hinging action. After the base and body members 10 and 12 are interlocked in the manner described previously, the end member 14 may then be interlocked with the body member 12. Thus, the end member 14 hinges with the base member 10 but locks to a closed position by interengaging with the overlying body member 12. In this regard, the body member 12 is provided with a locking post 66 having a tapered edge 68. To cooperate with this, the top wall 56 of the end member is provided with a through passage 70 with an edge thereof interlocking with the tapered edge 68 of the locking post 66.

For replacement of a fuse, the end member is simply disengaged with the locking post 66 on the body member 12 and the end member 14 is hinged along the hinge 18. When this hinging occurs, the force imposed by the base 62 of the prong 60 is relieved and the fuse 22 is essentially in a loose position in its accommodating pocket 20 and can be easily withdrawn. A new fuse 22' which has been stored in the cavity 25 within the base member 10 is withdrawn therefrom and inserted into the pocket 20 after which the the end member 14 is hinged back to its locked position. It is noted that because the two prongs are rotated away from each other to replace the fuse, this fuse replacement cannot occur with the plug plugged in.

Having described one preferred embodiment of the present invention, it should now be apparent that numerous other embodiments and modifications are contemplated as falling within the scope of this invention. For example, the fuse plug can be constructed in different sizes and could be adapted for accommodating different length or configuration fuses.

What is claimed is:

1. An improved combination plug and fuse holder adapted for receiving a multi-conductor cord and comprising;

a first insulated housing member having a passage for receiving the electric cord and a pocket extending substantially parallel to the passage and adapted to receive a first fuse, contact means for electrically coupling one conductor of said cord to one side of said first fuse, first prong means supported in said first insulated housing member for electrical coupling to the other conductor of the cord, a second insulated housing member including means for permitting the separation apart of the first and second housing members and for further interlocking these members, and a second prong means supported in said second insulated housing member extending in parallel with said first prong means but only in the interlocked position of said housing members, said second prong means for electrical coupling to the other side of said first fuse, said first insulated housing member comprising a base member and a body member, and means for relatively hinging said base and body members with said pocket and said passage defined therebetween, means for hinging said second housing member from said base member at one end thereof, said hinging means between said base member and said body member, and said hinging means between said base member and said second housing member being disposed, respectively, along different sides of said base member, said second insulated housing member supporting only said second prong means of said first and second prong means and said body member supporting only said first prong means of said first and second prong means, said second insulated housing member and said body member having one of two alternate positions relative to said base member including an interlocked position in which said first and second prong means extend in parallel and an open position in which said second insulated housing member and said body member are hinged away from said base member displacing said second prong means out of parallel with said first prong means and permitting access to said first fuse to enable removal thereof;

the improvement comprising a means within said first insulated housing member adapted to receive a second fuse in electrical isolation from said first fuse, said first prong means and said cord and whereby said second fuse is removable therefrom and interchangable with said first fuse only when said first and second insulated housing members are in the separated position.

2. The combination plug and fuse holder of claim 1 wherein the means to receive a second fuse comprises a cavity within said base member.

3. The combination plug and fuse holder of claim 2 wherein said cavity extends substantially parallel to said pocket and is separated from said pocket and from said first prong means by the material of said base member.

4. The combination plug and fuse holder of claim 3 wherein said pocket is within said base member and said passage is within said body member.

5. The combination plug and fuse holder of claim 5 wherein said second prong means has an internal end engageable with the other side of said fuse but only when said first and second housing members are interlocked.

6. The combination plug and fuse holder of claim 1 including means for interlocking said housing members together to form an integral device.

7. The combination plug and fuse holder of claim 1 including interlock means including a first interlock means for interlocking said base and body members and a second interlock means for interlocking said second insulated housing member and said body member.

8. The combination plug and fuse holder of claim 2 wherein said contact means has an end adapted to pierce said cord and make contact with said one conductor, and another end positioned to contact the one side of said fuse.

9. The combination plug and fuse holder of claim 8 wherein said first prong means has an end adapted to pierce the cord and make contact with said other conductor of said cord.

10. The combination plug and fuse holder of claim 9 further comprising means in said passage whereby the ends of said electric cord are prevented from touching.

11. The combination plug and fuse holder of claim 10 wherein said means comprises an extension of said passage corresponding to one conductor portion of said multi-conductor cord and whereby said cord is cut so that one conductor is longer than the other conductor and fits within said extension.

12. The combination plug and fuse holder of claim 11 wherein said end of said first prong means adapted to pierce said cord and make contact with said conductor is located within said extension of said passage.

13. The combination plug and fuse holder of claim 2 in combination with a first fuse in said pocket and a second fuse in said cavity wherein said fuses when in said pocket and said cavity extend beyond an end wall of said first insulated housing member.

14. The combination plug and fuse holder of claim 13 wherein said second insulated housing member has a recess therein for receiving the extending ends of said fuses.

* * * * *